United States Patent [19]

Rosenberg

[11] 3,987,568

[45] Oct. 26, 1976

[54] LETTER AND THE LIKE HAVING A SELF-ADJUSTING ORBITAL PIN-MOUNT FOR INSTALLING THE LETTER

[76] Inventor: Jerome Rosenberg, 11 Stauber Drive, Plainview, N.Y. 11803

[22] Filed: July 11, 1975

[21] Appl. No.: 595,166

[52] U.S. Cl. ..... 40/140; 85/1 F; 40/138

[51] Int. Cl.[2] ..... G09F 7/02

[58] Field of Search ..... 40/140, 142, 143, 138, 40/128; 403/229, 299, 307, 343; 85/1 F, 32 CS; 24/155

[56] References Cited

UNITED STATES PATENTS

| | | | |
|---|---|---|---|
| 333,303 | 12/1885 | Howard | 40/143 |
| 2,895,246 | 1/1959 | Menges | 40/138 |
| 2,916,839 | 12/1959 | Wheaton | 40/143 |
| 3,041,760 | 7/1962 | Slavsky | 40/10 R |
| 3,451,675 | 6/1969 | Burzenski | 403/229 X |

*Primary Examiner*—Hugh R. Chamblee
*Assistant Examiner*—Wenceslao J. Contreras
*Attorney, Agent, or Firm*—Shoemaker and Mattare, Ltd.

[57] ABSTRACT

A letter and the like having a self-adjusting orbital pin-mount for installing the letter and the like on walls and other surfaces, comprises a first member secured to a letter and extending rearwardly therefrom, an angularly and laterally yieldable spring member engaged at one end thereof on the first member, and a second member engaged at the other end of the spring member, whereby the second member thus automatically aligns itself to both angularly and laterally misaligned holes in walls or other surfaces to which the letter and the like is to be mounted, preventing stress and damage to the letter or pin-mount in the event of misaligned mounting holes.

12 Claims, 11 Drawing Figures

FIG. 1.
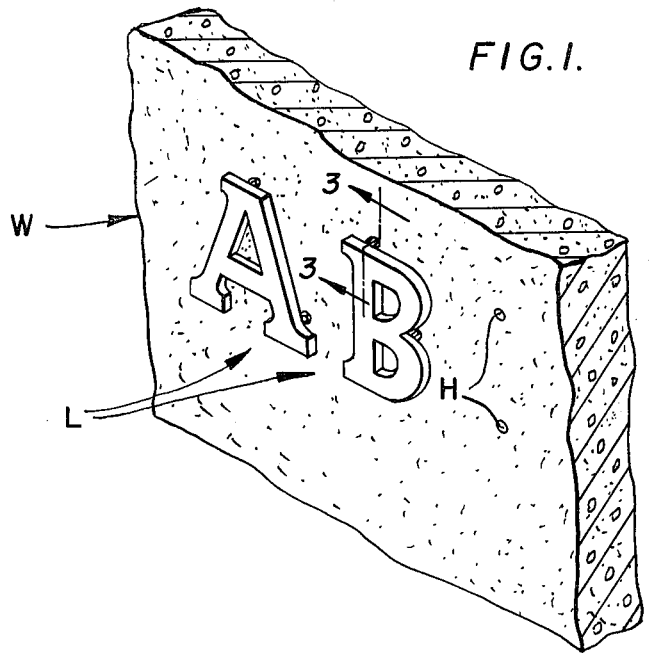
FIG. 3.
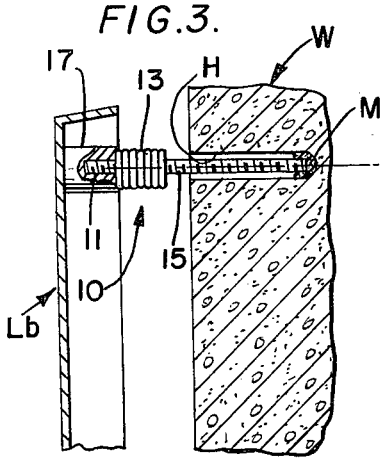
FIG. 4.
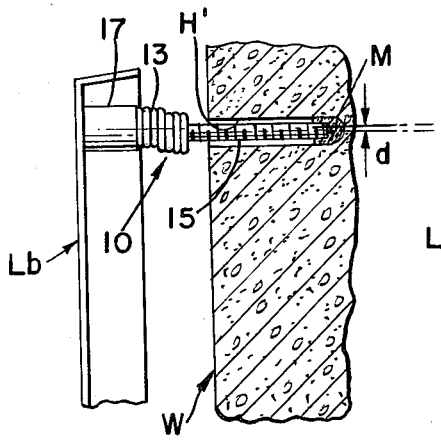
FIG. 5.
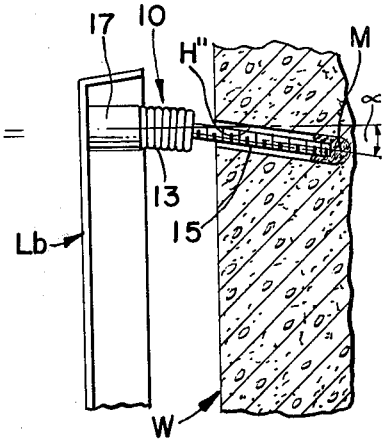
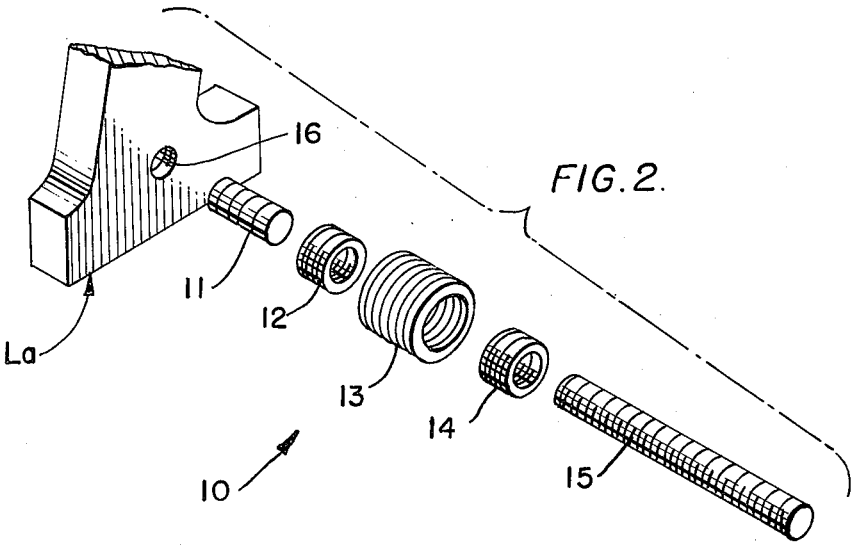
FIG. 2.

FIG. 6.
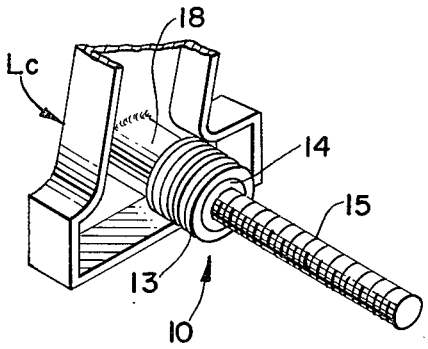
FIG. 7.
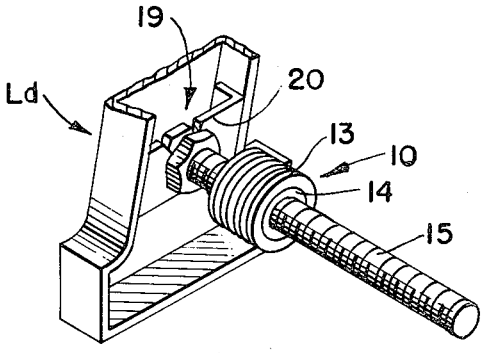
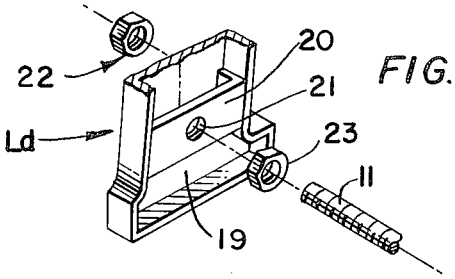
FIG. 8.
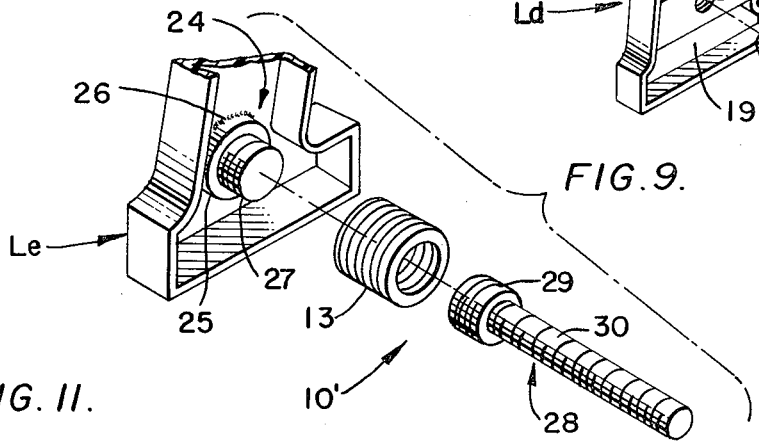
FIG. 9.
FIG. 11.
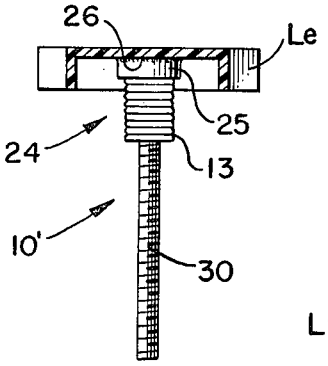
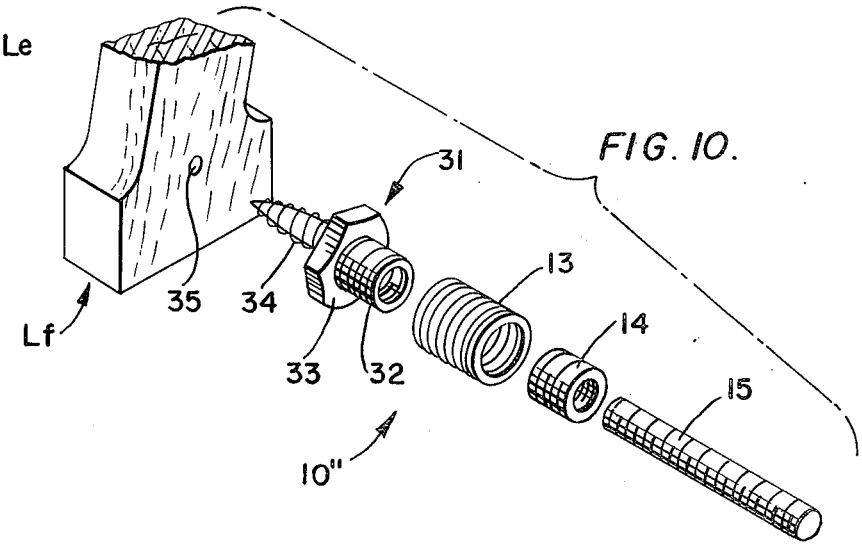
FIG. 10.

LETTER AND THE LIKE HAVING A SELF-ADJUSTING ORBITAL PIN-MOUNT FOR INSTALLING THE LETTER

BACKGROUND OF THE INVENTION

This invention relates to letters or other indicia for installation on masonry walls and the like or other surfaces, and more particularly, to a self-adjusting orbital pin-mount for installing the letters or other indicia and the like.

Numerous means and methods are used in the prior art to mount letters and other indicia to masonry walls and the like. Basically, manufactured plastic or metal letters and the like in the prior art are provided on the backs thereof with brackets or threaded rods and the like, commonly referred to as spindles or pins, having a diameter up to about one-fourth inch and cut to a predetermined length.

The procedure followed in the prior art for mounting such letters and other indicia to a wall or other surface is relatively complex, time consuming and expensive. First, a full-scale layout on heavy paper is prepared in the shop. The letters are spaced accordingly on the paper and then outlined in pencil, tracing the contours of each letter. When this has been accomplished, threaded studs are hand-screwed into the backs of the letters, where holes have been drilled and tapped to a partial depth in aluminum plate or cast metal letters. Other types of letters may require the use of spaced nuts on the threaded studs extended through a hole in a bracket behind the letter. With the studs or mounting pins set in the letters, the letters are superimposed over the paper layout in alignment with the previously drawn outline of the respective letters. With the letters precisely positioned, the centers of the pins are pencil marked where they fall on the layout. The layout pattern is now ready for installation of the letters. In the field, the paper layout is positioned and secured, as with tape or the like, on the building wall or other surface where the letters are to be mounted. The wall or other surface is usually made of brick, stone, wood or other material, and a star drill or other suitable drill means is employed to drill holes of a predetermined depth wherever the marked pin centers are indicated. Once the holes have been drilled, the template is removed and a cement or mastic or other adhesive is injected into the drilled holes. The mounting pins of the respective letters or other indicia are then introduced into the holes, which are supposed to match the position of the pins behind the letter. However, in actual practice it is extremely difficult to accurately drill holes in masonry freehand. For example, a hole may fall at the edge of a brick or fieldstone, which thus necessitates drilling as much as one-fourth inch off-center. Consequently, for a letter which has six mounting pins projecting therefrom, quite a problem is presented in alignment of the pins with the respective holes, since none of the holes may be precise in squareness or position with regard to the pins. Therefore, in the prior art it is necessary to force the mounting pins in the holes, with the end result that a letter is usually not straight and requires twisting, pushing and hammering to align it. When the letters and pins are forced in this manner, the letters are bent out of shape and may be damaged such as to render it unusable.

With the present invention, on the other hand, a unique yieldable pin-mount is provided that has an orbital or floating center at its base in order that the pin is self-adjusting to any angle of misalignment or lateral misalignment of the hole relative to the pins on a letter or other indicia.

OBJECTS OF THE INVENTION

It is an object of this invention to provide a letter or other suitable indicia for installation on a wall or other surface, wherein a mounting pin is provided on the rear surface of the letter for attaching the letter to the wall or other surface, and said mounting pin including an angularly and laterally yieldable section such that the mounting pin automatically accommodates itself to both angularly and laterally misaligned holes, whereby damage and excessive stress on the letter does not occur.

Another object of the invention is to provide a letter having a unique self-adjusting orbital pin-mount for installing the letter on masonry walls and the like, wherein the pin-mount includes an angularly and laterally yieldable portion, whereby the pin-mounts on the letters may be inserted into holes provided therefor merely by exerting gentle hand pressure on the letters, and without requiring forcing or bending or misalignment of the letters or pin-mounts.

BRIEF DESCRIPTION OF THE DRAWINGS

FIG. 1 is a perspective, fragmentary view of a portion of a masonry wall showing a pair of letters attached thereto.

FIG. 2 is an enlarged, exploded, perspective view of a portion of a letter and of a mounting pin according to the invention, and showing a first means for attaching the mounting pin to the letter.

FIG. 3 is a greatly enlarged, fragmentary view in section taken along line 3—3 of FIG. 1, showing a mounting pin according to the invention attached to the letter. In this Figure the mounting hole is properly aligned with the mounting pin on the letter.

FIG. 4 is a view similar to FIG. 3, showing the manner in which the present invention enables the mounting pin to accommodate itself to a laterally misaligned hole.

FIG. 5 is a view similar to FIG. 2, showing the manner in which the mounting pin according to the invention accommodates itself to an angularly misaligned hole.

FIG. 6 is a fragmentary, assembled, perspective view of a portion of a letter showing a first modified means for attaching the mounting pin to the letter.

FIG. 7 is a view similar to FIG. 6, showing a second modified means for attaching the mounting pin to the letter.

FIG. 8 is an enlarged, fragmentary, exploded, perspective view of the attaching means of FIG. 7.

FIG. 9 is an exploded, perspective, fragmentary view similar to FIG. 5, showing a third modified means for attaching the mounting pin to the letter.

FIG. 10 is a view similar to FIG. 9 of the fourth modification of the invention, showing an attaching means for attaching the mounting pin of the invention to a wood letter.

FIG. 11 is a view in section of the form of the invention shown in FIG. 9.

DETAILED DESCRIPTION OF THE INVENTION

In the drawings, wherein like reference numerals indicate like parts throughout the several views, a pair of letters L are shown mounted to a masonry wall W in FIG. 1. The letters L have mounting pins on the rear surface thereof engaged in mounting holes H formed in the wall W.

In FIG. 2, a first form of mounting pin 10 in accordance with the invention includes a first elongate threaded member 11 and a first internally and externally threaded adaptor sleeve 12 arranged to be threaded onto one end of the first elongate member 11. A flexible coil spring 13, having the same pitch as the threads on adaptor 12, is arranged to be threaded onto the adaptor 12 to thereby couple the spring or coupling member 13 to the first elongate member 11. A similar internally and externally threaded coupling member 14 is arranged to be threaded onto one end of a second elongate threaded member 15, whereby the other end of the spring or coupling member 13 may be engaged on coupling member 14 and thus joined to the second elongate threaded member 15, thereby forming an elongate mounting pin having an angularly and laterally yieldable portion between the ends thereof. The first elongate threaded member 11 is arranged to be threaded into tapped opening or hole 16 on the rear surface of a first form of letter $L_a$ formed of aluminum or other suitable material, to thereby attach the mounting pin 10 to the letter.

In FIG. 3 the unique self-adjusting mounting pin 10 is shown assembled to a modified letter $L_b$ of cast metal or plastic or other material, having a boss 17 projecting from the rear thereof and internally threaded for cooperation with the first elongate threaded member 11, and serving as an attaching means for attaching the mounting pin 10 to the letter. A hole H formed in a wall W is in alignment with the axis of the mounting pin, and accordingly, the pin is easily extended into the hole H without deformation thereof. A suitable cement or mastic M is placed in the hole H prior to insertion of the pin thereinto, such that when the second elongate member 15 of the pin is extended into the hole, it is adhesively secured by the mastic M in the hole.

In FIG. 4 the action of the unique mounting pin 10 is illustrated when a hole H′ is formed laterally offset from the axis of the boss 17 by a distance *d* and the yieldable coupling member or spring 13 is laterally deformed, whereby the second elongate threaded member 15 may be accurately positioned in the hole H′ without bending the same or bending the letter and thus exerting undue stress thereon and possibly causing damage thereto.

Likewise in FIG. 5, the invention is shown in use when a hole H″ is formed angularly offset by an angle $\alpha$ from the axis of the boss 17, and the yieldable coupling means or spring 13 is angularly deformed, enabling the second elongate member 15 of the mounting pin 10 to be extended accurately into the hole H″ without exerting stress and the like thereon.

In FIG. 6 a cast metal letter $L_c$ has an integrally formed boss 18 on the rear surface thereof, which is internally tapped for cooperation with the first elongate threaded member 11, as in the FIG. 3 embodiment, to attach the mounting pin 10 to the letter $L_c$.

In FIG. 7 the unique mounting pin 10 is shown attached by a modified attaching means 19 to a still further form of letter $L_d$ of conventional channel shape and made of a suitable material, such as metal or plastic and the like. The attaching means 19 comprises a bracket 20 suitably secured to the letter $L_d$ and having an opening 21 formed therethrough, through which the first elongate member 11 is extended. A pair of nuts 22 and 23 are threaded on the elongate member 11 from opposite sides of the bracket 20 to attach the mounting pin 10 to the letter $L_d$.

In FIG. 9 a further modification of the invention includes a letter $L_e$ vacuum formed from plastic and the like, and both a modified attaching means 24 and a modified mounting pin 10′ are provided. The attaching means 24 includes an enlarged, disc-shaped base 25 suitably secured as by means of an adhesive or cement or the like 26 to the rear surface of the letter $L_e$. An externally threaded boss 27 is formed on the base 25 and projects rearwardly therefrom for cooperation with the yieldable coupling means or spring 13 just as the collar 12 functions in the previously described embodiments. Thus, in this form of the invention, the threaded member 27 comprises the first elongate member. The second elongate member 28 in this form of the invention comprises an enlarged externally threaded portion 29 for cooperation with the spring 13 and an elongate, reduced diameter, externally threaded portion 30 for extension into the hole H, as in the previously described forms of the invention.

In FIG. 10 a still further modified form of the invention is indicated generally at 10″, and includes the spring 13, sleeve or adaptor 14 and second elongate threaded member 15, as in the previously described forms of the invention. However, rather than the first elongate threaded member 11, as in the FIGS. 2–8 embodiment, a combination elongate threaded member and adaptor 31 is provided, and comprises an externally threaded portion 32 for cooperation with the spring 13, and having a tool-engaging portion 33, such as a hexhead or the like, and an externally threaded wood screw portion 34 projecting from the side of the tool engaging portion opposite the threaded member 32 for engagement in a hole 35 formed in a wood letter $L_f$.

Thus, with all of the above-described forms of the invention, the mounting pin or pin-mount is self-centering and self-adjusting to any angle or lateral offset within reason, and without inducing stresses and the like in the letter or mounting pin. Accordingly, letters having the unique mounting means of the present invention attached thereto can be attached to walls or other surfaces by gentle hand pressure, even when the mounting holes therefor are misaligned.

Inasmuch as letters of the type with which the present invention is concerned are typically mounted outdoors, the mounting pin and the components thereof are preferably formed of non-corrosive materials, such as, for example, stainless steel, brass, aluminum, or plastic and the like.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A letter and the like having a self-adjusting orbital pin-mount for installing the letter and the like on walls and other surfaces, comprising: a first elongate member having opposite ends with screw-like thread means thereon and threadably connected at one end thereof to said letter and extending rearwardly therefrom, a first cylindrical adapter member having screw-like threads defined thereon and threadably connected to the other end of said first elongate member, a laterally and angularly yieldable coupling means having opposite ends, said coupling means being hollow and essentially cylindrical and having an inside diameter approximately equal to, but slightly larger than, the outside diameter of said first elongate member, said coupling means having one end thereof threadably coupled to the threads on the other end of said first adapter member to connect said coupling means to the other end of the first member in a manner such that said coupling means is permitted to flex while being reinforced by said first elongate member, a second cylindrical adapter member having screw-like threads defined thereon and threadably connected to the other end of said coupling means, and a second elongate member having an outside diameter approximately equal to, but slightly smaller than, the inside diameter of said coupling means and having screw-like thread means on at least one end thereof which is threadably connected to said coupling means at the other end of the yieldable coupling means in a manner such that said coupling means is permitted to flex while being reinforced by said second elongate member, said second member being adapted to extend at its other end into a mounting hole in a wall or other surface to secure the letter to the wall or other surface, the yieldable coupling means connecting said letter to said wall and being reinforced by said elongate members to have sufficient rigidity so that the letter can be applied and secured by hand pressure applied to the letter to a wall or other surface without creating excessive stress or damage to the letter or mounting pin, even in the event of misaligned mounting holes.

2. A letter as in claim 1, wherein attaching means is on the letter, and said first elongate member is engaged with the attaching means, securing the first elongate member to the letter.

3. A letter as in claim 2, wherein said yieldable coupling means comprises a coil spring.

4. A letter as in claim 3, wherein said first and second elongate members are externally threaded, and said first and second adapters are internally and externally threaded.

5. A letter as in claim 2, wherein said attaching means comprises a threaded hole in the rear surface of the letter, and said first elongate member is externally threaded and is threadably engaged in said hole, securing said mounting pin to said letter.

6. A letter as in claim 5, wherein a boss is on the rear of said letter, and said threaded hole is formed in said boss.

7. A letter as in claim 4, wherein said attaching means comprises a bracket fixed on a rear portion of said letter, said bracket having a hole therethrough and said first elongate member extending through said hole and first and second nuts engaged on said first threaded member on opposite sides, respectively, of the bracket, securing said first threaded member to the bracket and thus to the letter.

8. A letter as in claim 3, wherein said attaching means comprises a boss adhesively secured to the rear of the letter, and said first elongate member comprises an externally threaded extension of said boss, said coil spring engaged on the externally threaded extension.

9. A letter as in claim 8, wherein said second elongate member is externally threaded and has a diametrically enlarged end portion, said diametrically enlarged end portion threadably engaged in said spring.

10. A letter as in claim 3, wherein said attaching means comprises a self-tapping threaded member for threaded engagement in the letter, a tool-engaging enlargement on the attaching means for threading the attaching means to the letter, an externally threaded extension on the attaching means for cooperation with the coil spring, said second elongate member being externally threaded, and an internally and externally threaded adaptor threadably engaged on the end of said second elongate member and threadably engaged in the coil spring.

11. A letter as in claim 1 wherein said first elongate member screw-like thread means includes self-tapping threads on said one end for threadably attaching said first elongate member to said letter, and said first elongate member further includes a tool engaging means attached thereto for turning said first elongate member.

12. A letter as in claim 1 wherein said first elongate member further includes screw threads on said one end and nut-like attaching means on said one end for connecting said first elongate member to the bracket on said letter.

* * * * *